US007387375B2

(12) United States Patent
Nagashima

(10) Patent No.: US 7,387,375 B2
(45) Date of Patent: Jun. 17, 2008

(54) INKJET RECORDING HEAD AND INKJET RECORDING APPARATUS

(75) Inventor: Kanji Nagashima, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 334 days.

(21) Appl. No.: 11/087,862

(22) Filed: Mar. 24, 2005

(65) Prior Publication Data

US 2005/0212867 A1 Sep. 29, 2005

(30) Foreign Application Priority Data

Mar. 26, 2004 (JP) ..... 2004-093473

(51) Int. Cl.
*B41J 2/045* (2006.01)

(52) U.S. Cl. ..... 347/72; 347/71

(58) Field of Classification Search ..... 347/68–72; 310/331, 365, 366

See application file for complete search history.

(56) References Cited

U.S. PATENT DOCUMENTS

| | | | |
|---|---|---|---|
| 2003/0001931 | A1 | 1/2003 | Isono |
| 2003/0156157 | A1 | 8/2003 | Suzuki et al. |
| 2004/0041885 | A1 | 3/2004 | Hirota |

FOREIGN PATENT DOCUMENTS

| | | | |
|---|---|---|---|
| EP | 1 393 906 | A1 * | 3/2004 |
| JP | 57-167272 | A | 10/1982 |
| JP | 61-79669 | A | 4/1986 |
| JP | 6-226971 | A | 8/1994 |
| JP | 10-264389 | A | 10/1998 |
| JP | 11-105281 | A | 4/1999 |
| JP | 2001-85600 | A | 3/2001 |
| JP | 2001-0127241 | A | 5/2001 |
| JP | 2001-135779 | A | 5/2001 |
| JP | 2002-292865 | A | 10/2002 |
| JP | 2002-374685 | A | 12/2002 |
| JP | 2003-305852 | A | 10/2003 |
| JP | 2003-311953 | A | 11/2003 |

* cited by examiner

*Primary Examiner*—Stephen D Meier
*Assistant Examiner*—Geoffrey Mruk
(74) *Attorney, Agent, or Firm*—Birch, Stewart, Kolasch & Birch, LLP

(57) ABSTRACT

The inkjet recording head comprises: pressure chambers in which nozzles for discharging ink are formed; diaphragms which form portions of walls of the pressure chambers; laminated piezoelectric elements which are disposed on the diaphragms at a side opposite from the pressure chambers and are formed by alternately laminating piezoelectric elements and electrodes for driving the piezoelectric elements in a lamination direction; and lead electrodes which mutually join the electrodes that impart a same electric potential of the laminated electrodes in a plane orthogonal to the lamination direction.

21 Claims, 10 Drawing Sheets

INKJET RECORDING HEAD AND INKJET RECORDING APPARATUS

BACKGROUND OF THE INVENTION

1. Field of the Invention

The present invention relates to an inkjet recording head and an inkjet recording apparatus, and more particularly to an inkjet recording head and an inkjet recording apparatus using this head in which the configuration of the electrode leads of a laminated piezoelectric element is designed to ensure higher nozzle density.

2. Description of the Related Art

Conventionally, one known example of an image recording apparatus is an inkjet recording apparatus (inkjet printer) that has an inkjet head (ink discharge head) with an alignment of multiple nozzles, and that forms an image on a recording medium by discharging ink from the nozzles while moving the inkjet recording head and the recording medium relatively to each other.

Various methods for discharging ink in inkjet printers are conventionally known. One known example is a piezoelectric system, wherein changes the volume of a pressure chamber (ink chamber) by deforming a diaphragm that constitute part of the pressure chamber due to the deformation of a piezoelectric body (piezoelectric element) so that controls the ink supply and the ink discharge to the pressure chamber.

The nozzles formed in the inkjet recording head are preferably arranged with higher density in order to improve the performance of such an inkjet recording apparatus and to record high quality images. High-density, two-dimensional arrangement of nozzles is being considered for the purpose of bringing about a page-width head that achieves higher-speed and higher-efficiency recording. In an inkjet recording apparatus in which piezoelectric elements are used, there are known apparatuses that use a laminated piezoelectric body in order to obtain high ink ejection force and excellent controllability.

In an inkjet recording head in which a piezoelectric element is used, the wiring of the lead electrode had to be redesigned in order to increase the efficiency of the production of such an inkjet recording head.

An example of a known wiring structure of a piezoelectric body that dispenses with connecting leads to the piezoelectric transducer to increase productivity comprises a first electrode on the surface facing the pressure chamber of the pressurizing actuator (piezoelectric element); a second electrode in which a portion thereof is provided to the same surface via a gap between the first electrode and which extends to the other surface of the pressurizing actuator; and a third electrode on the surface facing the pressurizing actuator of the pressure chamber, wherein wiring is brought out from one side (specifically, the surface on the pressure chamber side) of a single-layered piezoelectric element (refer to Japanese Patent Application Publication No. 57-167272, and other publications).

Also known is an inkjet recording head designed to eject ink droplets with high efficiency, in which electrode-formation material and piezoelectric material are alternately laminated, and in which a pressurizing actuator is configured so that an active area is formed in the center portion, and expansion and contraction occur in the direction of lamination, wherein the pressurizing actuator and a fixed plate form a contact area solely in the active area, and by fixing both components exclusively in the contact area, the active area alone expands in the direction of lamination when a drive signal is applied, the stress of the edge portion of the pressurizing actuator is low, and the degree of expansion in the direction of the electrode arrangement is made larger (refer to Japanese Patent Application Publication No. 6-226971, and other publications).

Also known is a structure in which an inactive portion of the piezoelectric body that is essentially not driven is provided to the external side of the active portion of the piezoelectric body, the effect of the electric field in the edge of the inactive portion of the piezoelectric body produced by the application of voltage to the active portion of the piezoelectric body is eliminated by a configuration in which the distance from the edge of the inactive portion of the piezoelectric body to the edge of the active portion of the piezoelectric body is substantially triple or more the thickness of the piezoelectric layer, and the inactive portion of the piezoelectric body is not driven. Although the piezoelectric layer is not laminated, the piezoelectric body and the electrode are formed into a stepped structure that prevents peeling and cracking in the edges of the active portion of the piezoelectric body (refer to Japanese Patent Application Publication No. 11-105281, and other publications).

Also known is a droplet ejection apparatus in which voltage is applied to the plates of piezoelectric material by using a first electrode and second electrode disposed inside the piezoelectric material in a configuration in which the piezoelectric material in the form of sheets is laminated, and droplets are ejected, wherein the piezoelectric material is formed across the entire surface of the liquid chamber, but the electrode pattern of the first electrode is formed so that the surface area thereof becomes sequentially smaller from the lower portion to the upper portion in the thickness direction of the plates of piezoelectric material, the electrode pattern of the second electrode is formed so that the surface area thereof becomes sequentially larger from the lower portion to the upper portion in the thickness direction of the plates of piezoelectric material, the plates of piezoelectric material are deformed in the expansion and contraction direction that is sloped in the direction of the surface thereof by applying voltage from the first and second electrodes to eject droplets, thereby improving the energy efficiency and imparting an adequate amount of deformation to the plates of piezoelectric material even if the drive voltage is low (refer to Japanese Patent Application Publication No. 2002-292865, and other publications).

Another known art is one in which a nozzle plate, an ink flow channel plate, an insulating plate, a bimorphous polyvinylidene fluoride (PVDF) plate, and a flexible print substrate are sequentially laminated and an inkjet head is adhesively formed, wherein through holes for electrical connections are formed in the bimorphous PVDF plate and the flexible print substrate, and the head electrically connected from one side (refer to Japanese Patent Application Publication No. 61-79669, and other publications, and particularly FIG. 1 of Japanese Patent Application Publication No. 61-79669).

Also known is an apparatus in which a common electrode is formed and on both sides of a laminated piezoelectric member composed of two layers, individual electrodes are disposed in the boundary portion of the two layers, and the electrode layers are formed into steps (refer to Japanese Patent Application Publication No. 10-264389, and other publications, and particularly FIG. 6 of Japanese Patent Application Publication No. 10-264389).

However, there are drawbacks when a laminated piezoelectric body is used to achieve a higher nozzle density in the inkjet recording heads described above in that the head cannot be wired from the side, and it is difficult to achieve high-density integration. More particularly, it is difficult to dispose the laminated piezoelectric bodies in a high-density, two-dimensional arrangement because, in the laminated piezoelectric element of prior art cited in Japanese Patent Application Publication No. 6-226971, for example, piezoelectric material and electrode formation material are alternately laminated, the resulting laminate with large dimensions is baked, and the laminate is then cut with a diamond saw or the like to manufacture a head.

Because such a laminate is cut into strips to manufacture a head, only rectangular laminated piezoelectric bodies can be fabricated, and the piezoelectric layers that form the laminate must have the same shape. Therefore, the surface area of the active portion of the piezoelectric body is made as large as possible, and there is a limit to increasing force from the piezoelectric body.

This is due to the fact that wiring is conventionally performed after the piezoelectric body is mounted in the inkjet recording head, and a gap is therefore required to prevent the wiring of adjacent piezoelectric elements from shorting, and work to provide side surface wiring is required.

Also, the apparatus cited in Japanese Patent Application Publication No. 2002-292865 is formed so that the size of the electrodes disposed inside the plates of piezoelectric material sequentially become smaller, and because the size of the plates of piezoelectric material covers the entire surface of the liquid chamber, the wiring from one surface of the piezoelectric body does not have a structure that allows a connection, and there is still a drawback in that it is difficult to achieve higher density.

The piezoelectric bodies cited in Japanese Patent Application Publication Nos. 57-167272 and 11-105281 are single-layered and not laminated piezoelectric bodies, the structure is completely different from inkjet recording heads that use laminated piezoelectric elements, and there is a drawback in that it is difficult to apply these bodies to art aimed at increasing density using laminated piezoelectric elements.

The art cited in Japanese Patent Application Publication No. 61-79669 provides through holes to make electrical connections to a bimorphous PVDF plate and a flexible print substrate, and there the drawback is that it is difficult to achieve a higher density. Also, a configuration suitable for a method of connecting laminated piezoelectric bodies composed of a greater number of layers is not disclosed in Japanese Patent Application Publication No. 61-79669.

In the apparatus cited in Japanese Patent Application Publication No. 10-264389, the common electrode and individual electrodes are disposed adjacent to each other, and the drawback is that it is still difficult to achieve a higher density. Furthermore, a configuration suitable for a method of connecting laminated piezoelectric bodies composed of a greater number of layers is not disclosed in Japanese Patent Application Publication No. 10-264389, either.

SUMMARY OF THE INVENTION

The present invention has been contrived in view of such circumstances, and an object thereof is to provide an inkjet recording head and an inkjet recording apparatus in which this head is used and in which the surface area of the active portion of the piezoelectric body is increased to achieve a higher ink ejection force, and a laminated piezoelectric element with excellent controllability is disposed with high density to improve the print performance.

In order to attain the aforementioned object, the present invention is directed to an inkjet recording head, comprising: pressure chambers in which nozzles for discharging ink are formed; diaphragms which form portions of walls of the pressure chambers; laminated piezoelectric elements which are disposed on the diaphragms at a side opposite from the pressure chambers and are formed by alternately laminating piezoelectric elements and electrodes for driving the piezoelectric elements in a lamination direction; and lead electrodes which mutually join the electrodes that impart a same electric potential of the laminated electrodes in a plane orthogonal to the lamination direction.

The surface area of the active portion of the piezoelectric element can thereby be increased and high ink ejection force can be obtained because wiring can be brought out from a single direction and electrodes can be reliably brought out with a minimal loss of surface area of the active portion in which the piezoelectric element effectively works.

Preferably, dimensions in a crosswise direction of joining portions between the lead electrodes and the electrodes that impart the same electric potential of the laminated electrodes are sequentially changed for the laminated layers, respectively; and the joining portions of the electrodes that impart the same electric potential of the laminated electrodes with the lead electrodes are shifted in a stepped fashion. Thus, manufacturing suitability can be improved and the electrodes can be brought out from a single direction in a simple manner by forming the piezoelectric elements constituting the laminated piezoelectric element in a stepped fashion so as to sequentially reduce the dimension in the crosswise direction.

Preferably, uppermost surfaces of the laminated piezoelectric elements are joined with a flexible cable. The driving force of the piezoelectric element can thereby be transmitted to the diaphragm with good efficiency by pressing from above the piezoelectric element that expands and contracts in the vertical direction.

Preferably, the electrodes comprise a common electrode which is commonly linked to the laminated piezoelectric elements and individual electrodes that individually drive the laminated piezoelectric elements; the pressure chambers are two-dimensionally arrayed; and the lead electrodes that are joined with the common electrode are disposed facing each other in mutually adjacent positions.

Preferably, the electrodes comprise a common electrode which is commonly linked to the laminated piezoelectric elements and individual electrodes that individually drive the laminated piezoelectric elements; the pressure chambers are two-dimensionally arrayed; and the lead electrodes that are joined with the individual electrodes are disposed in mutually adjacent positions so as not to face each other.

Preferably, the electrodes comprise a common electrode which is commonly linked to the laminated piezoelectric elements and individual electrodes that individually drive the laminated piezoelectric elements; the pressure chambers are two-dimensionally arrayed; the lead electrodes that are joined with the common electrode are disposed facing each other in mutually adjacent positions; and the lead electrodes that are joined with the individual electrodes are disposed in mutually adjacent positions so as not to face each other.

Such an arrangement allows the gap between the common electrode side (ground-side electrode) of the piezoelectric element to be narrowed, the individual electrode-side (active electrode side) to be provided in a proximal position as possible without shorting, and a higher density arrangement to be achieved.

Preferably, inactive portions of the piezoelectric elements and the joining portions of the electrodes are provided to portions in which apertures of the pressure chambers are not present. In the particular case of arranging the pressure chambers in a two-dimensional configuration, the portion occupying the pressure chambers is a square shape, a rhombic shape, a hexagonal shape, or another shape that allows maximum density packing, and in the pressure chambers thusly shaped, the ejection force of the piezoelectric elements can be increased by providing in this manner a joining portion for the electrodes and an inactive portion of the piezoelectric element so as to include the portion in which the gap is wide between the neighboring pressure chambers directly above the portion in which pressure chambers are not present.

In order to attain the aforementioned object, the present invention is also directed to an inkjet recording apparatus, comprising the above-described inkjet recording head. According to the present invention, the printing performance can be improved, and a high quality image can be recorded at high speed by providing such an inkjet recording head.

As described above, in accordance with the inkjet recording head and the inkjet record apparatus of the present invention, by reliably bringing out wiring from the electrodes in a single direction, the reduction in the effective surface area of the piezoelectric elements can be minimized, the surface area of the active portion of the piezoelectric element can be increased, a high ink ejection force can be obtained, and a higher density arrangement of laminated piezoelectric elements can be achieved.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 7A is a three-dimensional, exploded perspective view of each layer, and FIG. 7B is a diagram showing the state in which the portion below the flexible cable is laminated;

FIG. 8A is a three-dimensional, exploded perspective view of each layer, and FIG. 8B is a diagram showing the state in which the portion below the flexible cable is laminated;

DETAILED DESCRIPTION OF THE PREFERRED EMBODIMENTS

Figure 1:
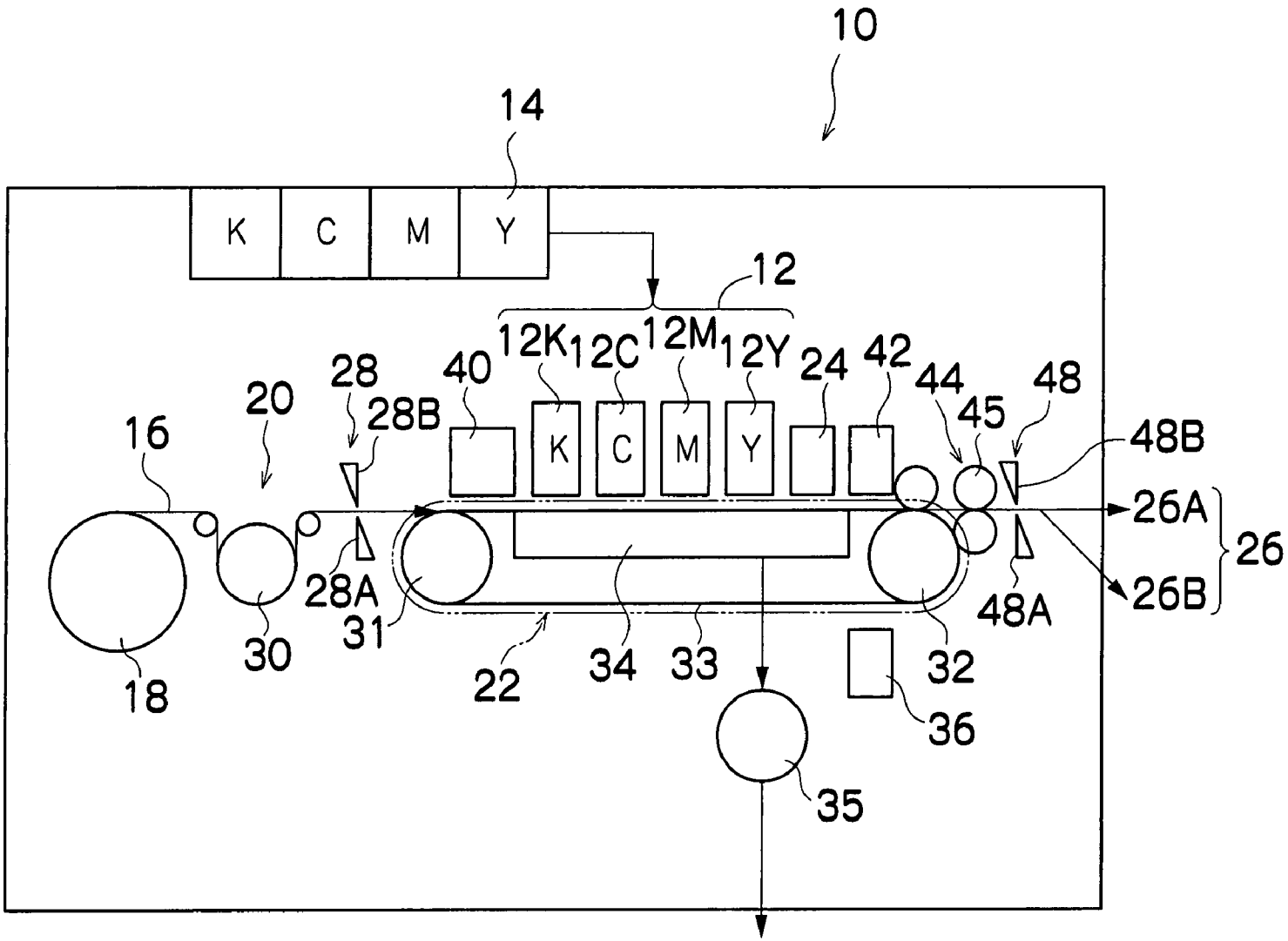
FIG. 1 is a general schematic drawing of an inkjet recording apparatus according to an embodiment of the present invention.

FIG. 1 is a general schematic drawing of an inkjet recording apparatus according to an embodiment of the present invention. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing/loading unit 14 for storing inks to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a single magazine for rolled paper (continuous paper) is shown as an example of the paper supply unit 18; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is equal to or greater than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not depicted, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the line velocity of the cleaning roller different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

The printing unit 12 forms a so-called full-line head in which a line head having a length that corresponds to the maximum paper width is disposed in the main scanning direction perpendicular to the delivering direction of the recording paper 16 (hereinafter referred to as the paper conveyance direction), which is substantially perpendicular to a width direction of the recording paper 16. Each of the print heads 12K, 12C, 12M, and 12Y is composed of a line head, in which a plurality of ink-droplet ejection apertures (nozzles) are arranged along a length that exceeds at least one side of the maximum-size recording paper 16 intended for use in the inkjet recording apparatus 10.

The print heads 12K, 12C, 12M, and 12Y are arranged in this order from the upstream side along the paper conveyance direction. A color print can be formed on the recording paper 16 by ejecting the inks from the print heads 12K, 12C, 12M, and 12Y, respectively, onto the recording paper 16 while conveying the recording paper 16.

Although the configuration with the KCMY four standard colors is described in the present embodiment, combinations of the ink colors and the number of colors are not limited to those, and light and/or dark inks can be added as required. For example, a configuration is possible in which print heads for ejecting light-colored inks such as light cyan and light magenta are added.

As shown in FIG. 1, the ink storing/loading unit 14 has tanks for storing the inks to be supplied to the print heads 12K, 12C, 12M, and 12Y, and the tanks are connected to the print heads 12K, 12C, 12M, and 12Y through channels (not shown), respectively. The ink storing/loading unit 14 has a warning device (e.g., a display device, an alarm sound generator) for warning when the remaining amount of any ink is low, and has a mechanism for preventing loading errors among the colors.

The print determination unit 24 has an image sensor for capturing an image of the ink-droplet deposition result of the print unit 12, and functions as a device to check for ejection defects such as clogs of the nozzles in the print unit 12 from the ink-droplet deposition results evaluated by the image sensor (line sensor).

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements, which are arranged two-dimensionally.

The print determination unit 24 reads a test pattern printed with the print heads 12K, 12C, 12M, and 12Y for the respective colors, and the ejection of each head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathway in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in the diagram, a sorter for collecting prints according to print orders is provided to the paper output unit 26A for the target prints.

Figure 2:
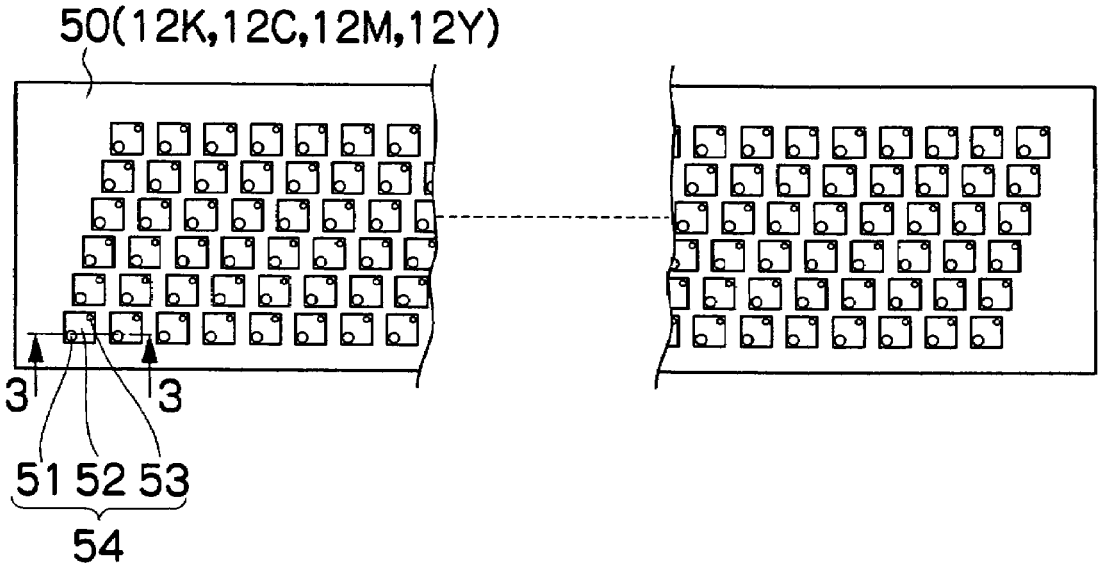
FIG. 2 is a perspective plan view showing an example of the configuration of the print head 50.

Next, the structure of the print heads is described. The print heads 12K, 12C, 12M and 12Y have the same structure, and a reference numeral 50 is hereinafter designated to any of the print heads 12K, 12C, 12M and 12Y. FIG. 2 is a perspective plan view showing an example of the configuration of the print head 50.

As shown in FIG. 2, the print head 50 of the present embodiment ensures a higher density of nozzles 51 with a configuration in which pressure chamber units 54 that are configured with nozzles 51 for discharging ink, pressure chambers 52 for imparting pressure to the ink when discharging ink, and ink supply ports 53 for feeding ink from the common flow channel (not shown) to the pressure chambers 52 are two-dimensionally arrayed.

The pressure chamber 52 has a substantially square shape when observed from above, as shown in FIG. 2, the nozzles 51 are formed in one end of the diagonal line thereof, and the ink supply port 53 is provided at the other end.

Figure 3:
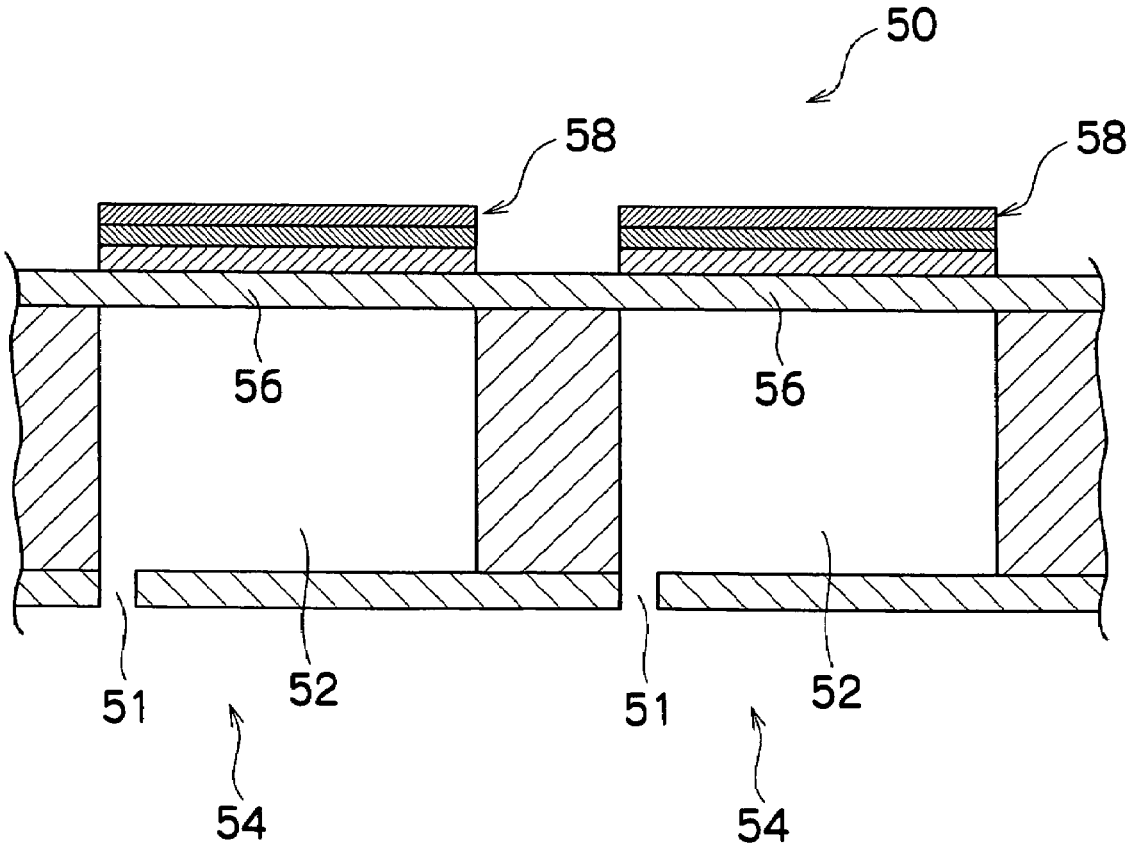
FIG. 3 is a cross-sectional view along the line 3-3 of FIG. 2.

Shown in FIG. 3 is a cross-sectional view of two pressure chamber units 54 cut along the dotted line 3-3 shown in FIG. 2. The pressure chamber unit 54 has a pressure chamber 52 whose upper surface is composed of a diaphragm 56, and formed thereon is a laminated piezoelectric element 58, as shown in FIG. 3. The laminated piezoelectric element 58 will be described detail later, but the element is formed by alternately laminating a thin film piezoelectric element and electrodes. The laminated piezoelectric element 58 is caused to expand in the vertical direction by applying voltage to the piezoelectric elements through a flexible cable or the like (not shown), the diaphragm 56 is thereby caused to deform downward, and the ink inside the pressure chamber 52 that is fed from the common flow channel (not shown) is ejected from the nozzles 51 due to the reduced volume of the pressure chamber 52.

Figure 4:
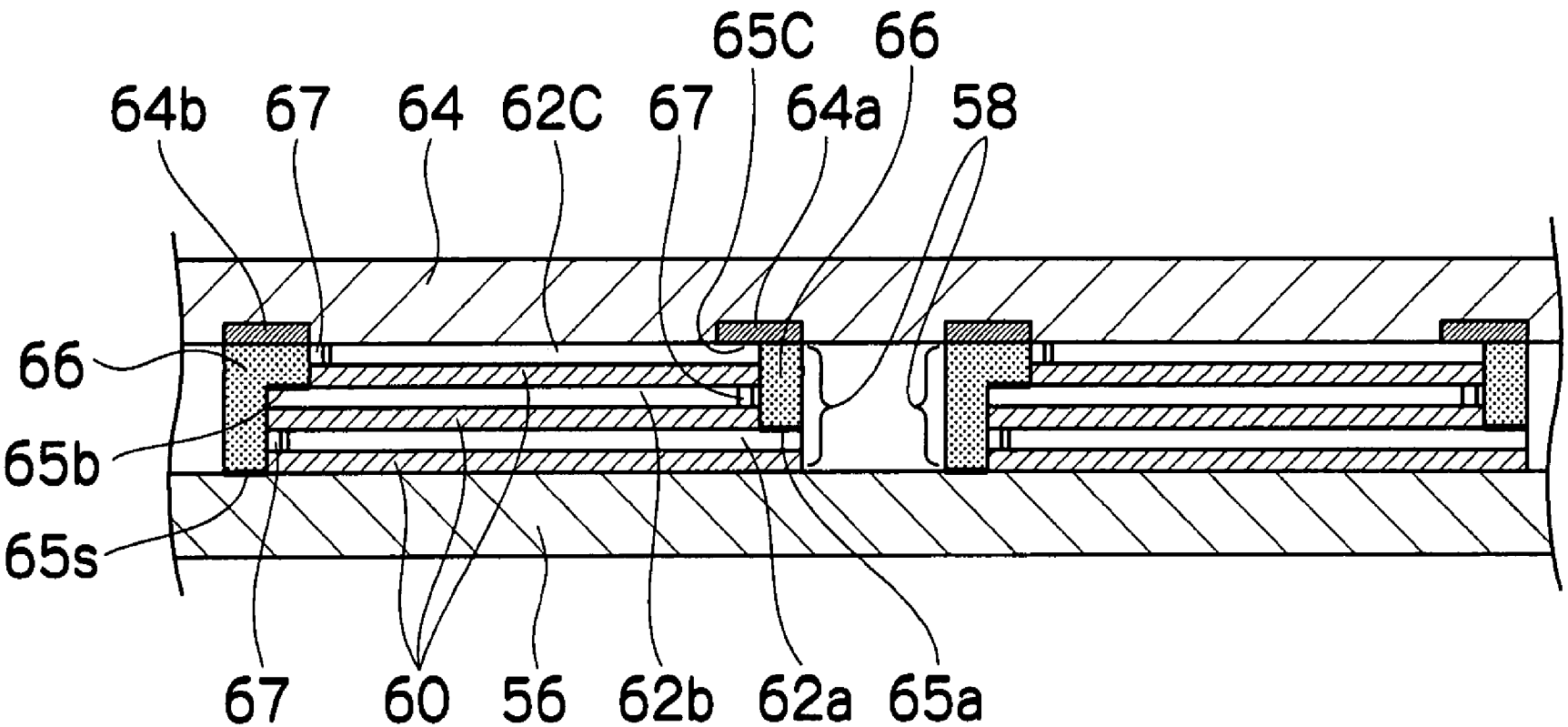
FIG. 4 is an enlarged cross-sectional view of the laminated piezoelectric element in FIG. 3 showing the general configuration thereof.

A detailed configuration of the diaphragm 56 and laminated piezoelectric element 58 is shown in the cross-section diagram of FIG. 4. It should be noted that FIG. 4 shows only the portion above the diaphragm 56, and although omitted from the diagram in FIG. 4, pressure chambers 52 (apertures thereof) are present below the diaphragm 56 in positions corresponding to the laminated piezoelectric elements 58 disposed on the diaphragm 56.

The laminated piezoelectric element 58 formed on the diaphragm 56 is configured with a thin films of piezoelectric elements 60 and electrodes 62 (62*a*, 62*b*, and 62*c*) alternately laminated, and a flexible cable 64 is disposed on the upper portion of the laminated piezoelectric element 58, as shown in FIG. 4. The electrodes 62*a* and 62*c* are individual electrodes (active electrodes), and conductive portions 65*a* and 65*c* are provided to the upper surface edges of the electrodes 62*a* and 62*c*. The electrodes 62*a* and 62*c* are joined to the active-side terminal 64*a* (lead electrode) of the flexible cable 64 with solder 66 (lead electrode) by way of the conductive portions 65*a* and 65*c* (or joined directly).

The electrode 62*b* and diaphragm 56 are common electrodes (ground-side electrodes), a conductive portion 65*b* is provided to the upper surface of the edge of the electrode 62*b*, and a conductive portion 65*s* is provided to the edge of the area (described hereinafter, refer to FIG. 7A) in which the laminated piezoelectric element 58 on the upper surface of the diaphragm 56 is laminated. The electrode 62*b* and the diaphragm 56 are joined to the ground-side terminal 64*b* of the flexible cable 64 with solder 66 by way of the conductive portions 65*b* and 65*s*.

It should be noted that the conductive portions 65 are surface treated (by plating, for example) in order to improve the joining characteristics between the solder and the common electrode or the individual electrodes, and the conductive portions 65 are not required.

At this time, the electrodes 62 (62*a*, 62*b*, and 62*c*) are formed in a stepped fashion so as to sequentially reduce the dimension in the direction (upward direction in FIG. 4) facing the joining side. Also, the piezoelectric elements 60 are sandwiched between the electrode 62*b* and the diaphragm 56, which serves as the common electrode, and between the electrodes 62*a* and 62*c*, which are individual electrodes (active electrodes). To prevent the ground-side electrode and the active-side electrode from being connected, an insulating portion 67 is provided between the active-side electrodes 62*a* and 62*c*, and the solder 66 that connects the ground-side electrode 62*b* and diaphragm 56, and between the ground-side electrodes 62*b* and the solder 66 that connects the active-side electrodes 62*a* and 62*c*.

Also at this time, the manufacturing efficiency can be enhanced by arranging the solder 66 to use the same material as the electrodes 62 (62*a*, 62*b*, and 62*c*), and arranging the insulating portion 67 to use that same material as the piezoelectric elements 60.

Thus, in the present embodiment, since the dimensions of the electrodes 62 (62*a*, 62*b*, and 62*c*) and the piezoelectric elements 60 that are laminated are different for each layer (at least partially), and these are layered in a stepped fashion so as to become sequentially smaller in the joining direction, the laminated piezoelectric elements 58 shown in FIG. 4 are configured so that each step (the terminal portions of the electrodes 62) can be seen when viewed from above. Therefore, all the electrodes 62 (62*a*, 62*b*, and 62*c*) of the laminated piezoelectric elements 58 can be brought out from the upper surface of the terminal portions using the stepped portion of the steps that can be seen from above.

It should be noted that in the example shown in FIG. 4, both the active-side electrode and the ground-side electrode are brought out from the upper surface of the laminated piezoelectric element 58, but the connecting portion from these electrodes may be provided to a portion other than the upper surface.

Next, another configurational example of the laminated piezoelectric element 58 and other components above diaphragm 56 will be described.

Figure 5:
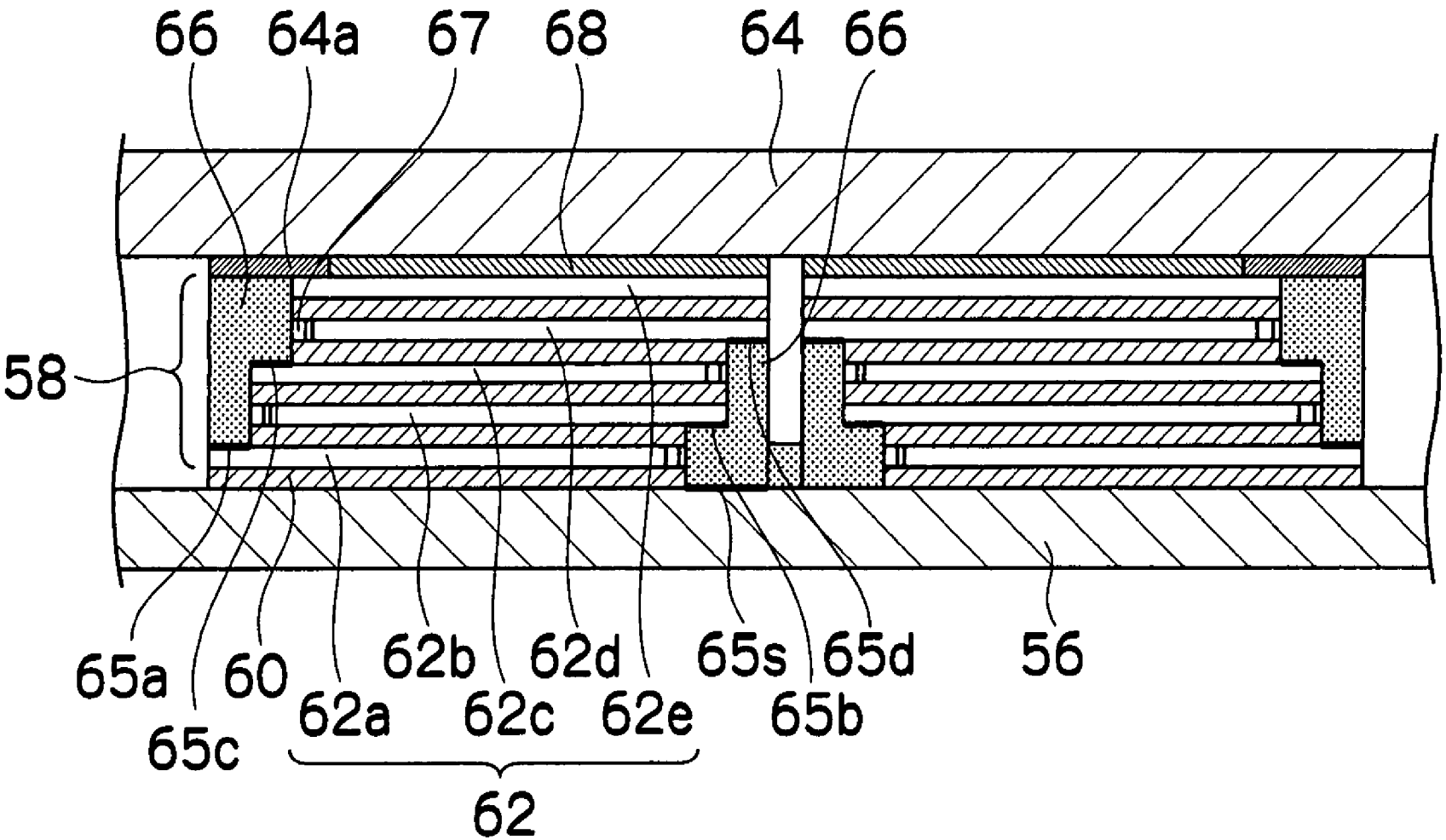
FIG. 5 is a cross-sectional view showing another configurational example of the laminated piezoelectric element portion.

FIG. 5 is a cross-sectional view showing another configurational example of the laminated piezoelectric element 58 and other components. In the example shown in FIG. 5, the laminated piezoelectric element 58 is configured with five layers each of thin film piezoelectric elements 60 and electrodes 62 (62*a* to 62*e*) that differ in dimensions for each layer, and the layers are positionally offset and laminated in a stepped fashion. The electrodes 62*a*, 62*c*, and 62*e* on the active side are joined from the conductive portions 65*a*, 65*c*, and 65*e* on the upper surface of the stepped edges to the active-side terminal 64*a* of the flexible cable 64 with solder 66 (or joined directly). The electrodes 62*b* and 62*d* on the ground side are joined with solder from the conductive portions 65*b* and 65*d* on the lower surface of the stepped edges to the diaphragm 56 that doubles as the ground-side electrode.

To prevent the ground-side electrode and the active-side electrode from being connected, an insulating portion 67 is provided at prescribed locations in the same manner as in the example of FIG. 4. Furthermore, in the example in FIG. 5, the uppermost surface (flexible cable 64 side of the portions other than the portions that are conductive with the active-side terminal 64*a*) of the laminated piezoelectric element 58 is directly bonded to the flexible cable 64 with the bonding portion 68.

Thus, the driving force of the laminated piezoelectric element 58 can be efficiently transmitted to the diaphragm 56 because the laminated piezoelectric element 58 is pressed from above by the direct joining of the flexible cable 64 across substantially the entire upper surface of the laminated piezoelectric element 58.

Figure 6:
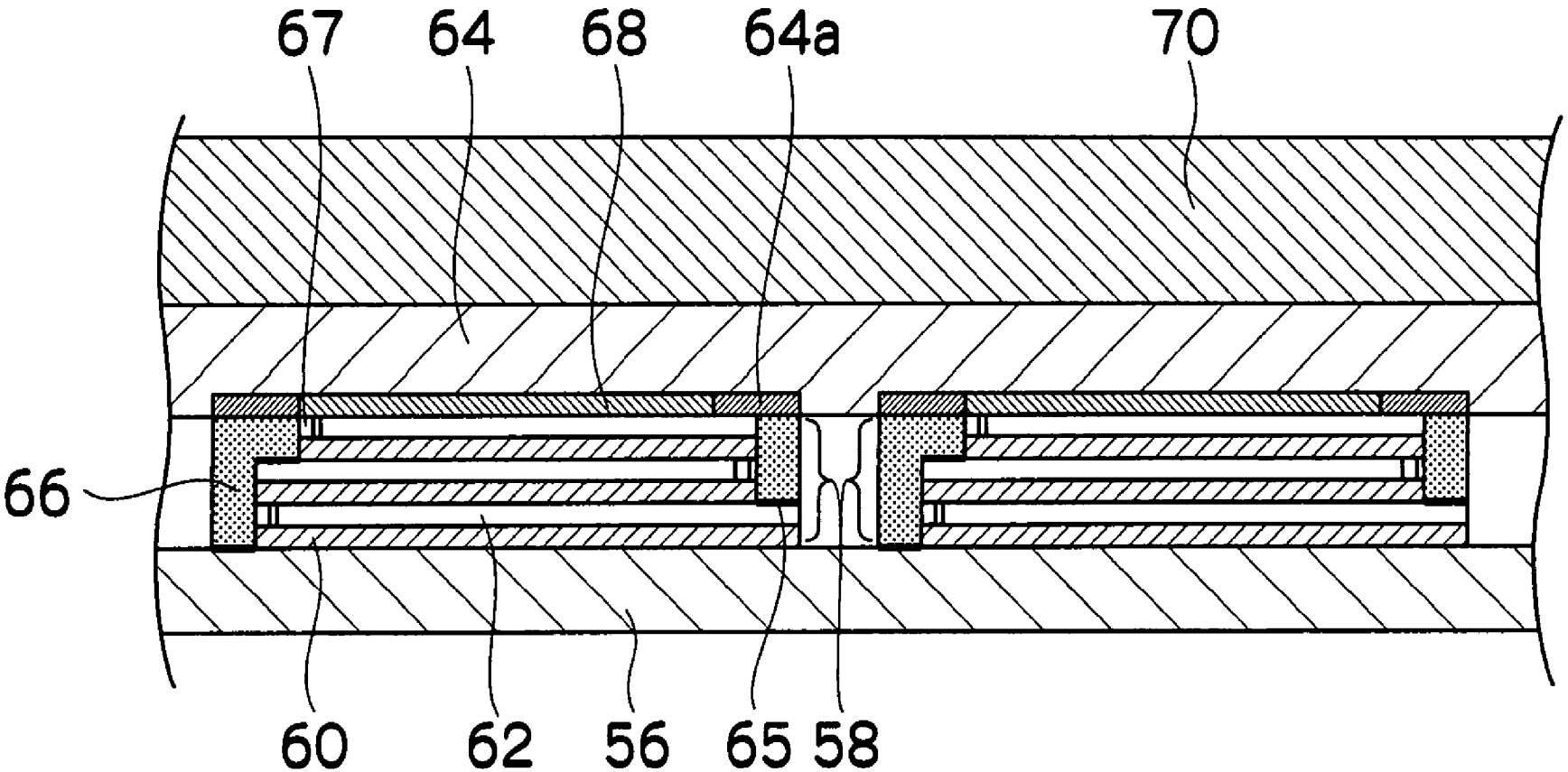
FIG. 6 is cross-sectional view showing yet another configurational example of the laminated piezoelectric element portion.

Yet another configurational example is shown in FIG. 6. In the example shown in FIG. 6, the method of bringing out the electrodes 62 and the laminated portions of the laminated piezoelectric element 58 is the same as in the example of FIG. 4, and the uppermost surface of the laminated piezoelectric element 58 is joined to the flexible cable 64 with the adhesive portion 68 in the same manner as in the example of FIG. 5. In the example of FIG. 6, a weight 70 is mounted on the uppermost surface (side opposite from the laminated piezoelectric element 58) of the flexible cable 64 in order to improve the transmission efficiency of the driving force of the laminated piezoelectric element 58.

The weight 70 is not particularly limited, but preferable is one that takes the form of a plate so as to cover substantially the entire surface of the flexible cable 64, takes the form of a metal plate, is electrically grounded, and works to cut off electrical noise emitted from the flexible cable 64.

Next, the method for manufacturing such a laminated piezoelectric element 58 is described.

Figure 7A:
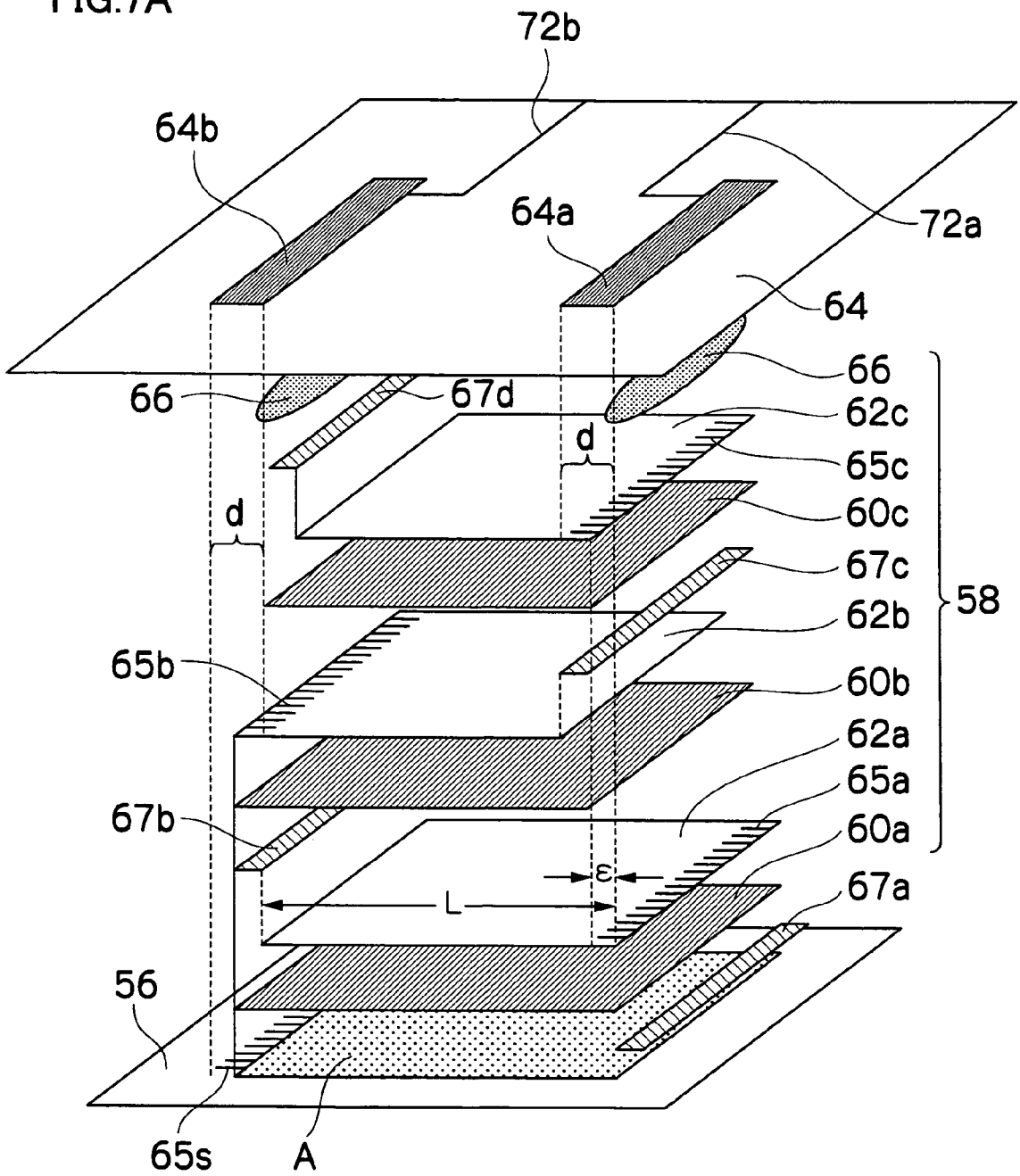
FIGS. 7A and 7B are diagrams showing a method of laminating the laminated piezoelectric elements.
Figure 7B:
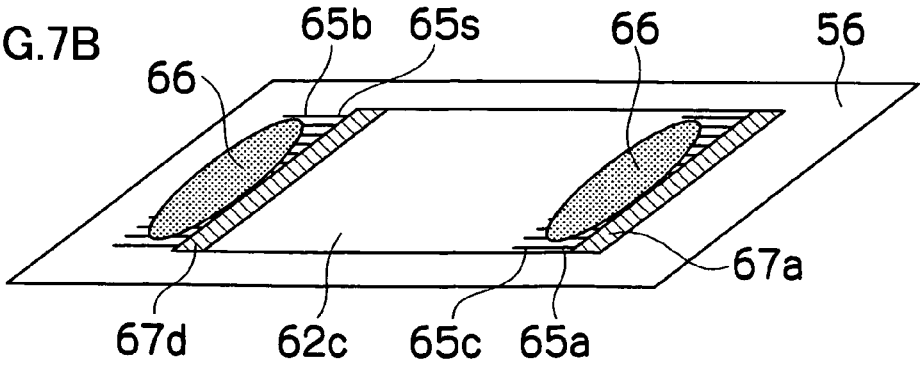

As an example of a manufacturing method, FIGS. 7A and 7B shows a method of laminating the laminated piezoelectric elements 58 shown in FIG. 4. FIG. 7A is a three-dimensional, exploded perspective view of each layer, and FIG. 7B is a diagram showing the state in which the portion below the flexible cable 64 is laminated.

In FIG. 7A, the lowest portion is a diaphragm 56 composed of stainless steel or the like, and this is the base of the electrode (ground-side electrode, common electrode). The area A shown on the diaphragm 56 is the range within which the laminated piezoelectric elements 58 are stacked up in the area. The portion on the right-hand side of area A is a conductive portion 65*s* in which the diaphragm 56 that serves as the base electrode is joined to the terminal 64*a* of the flexible cable 64 by solder 66.

The shaded portion (not particularly shown in FIG. 4) of the right-hand side upper portion of the area A is the insulating portion 67*a* which prevents the solder 66 for joining the active-side electrode from shorting to the diaphragm 56.

First, a thin film piezoelectric element 60*a* is laminated in the area A of the diaphragm 56. At this time, since the piezoelectric element 60*a* is formed on the area A, the conductive portions 65*s* on the left-hand side of area A extend outward to the exterior of the piezoelectric element 60*a*. Also, as described above, the piezoelectric element 60*a* and insulating portion 67*a* are preferably composed of the same material, and by composing these of the same material, they can be simultaneously formed.

The electrode 62*a* on the active side is formed on the piezoelectric element 60*a*. At this time, the left-hand side of the electrode 62*a* is formed so as to be smaller than the piezoelectric element 60*a* by an amount equal to the portion on which the insulating portion 67*b* is formed. Also, the shaded portion on the right-hand edge of the electrode 62*a* is the conductive portion 65*a* for joining the active-side terminal 64*a* of the flexible cable 64 with solder 66.

Next, the piezoelectric element 60*b* and insulating portion 67*b* are formed on the electrode 62*a* on the active side. At this time, the piezoelectric element 60*b* is formed so as to be smaller by an amount equal to the conductive portion 65*a* on the right-hand side of the electrode 62*a*. The electrode 62*b* on the ground side is subsequently formed on the piezoelectric element 60*b*. The electrode 62*b* is formed smaller by amount equal to the insulating portion 67*c* that is formed next, and the shaded portion on the left-hand edge side thereof is the terminal 64*a* of the flexible cable 64 and the conductive portion 65*b* for joining with the solder 66.

Next, the piezoelectric element 60*c* and insulating portion 67*c* are formed on the electrode 62*b*. At this time, the left-hand side of the piezoelectric element 60*d* is formed so as to be smaller by an amount equal to the conductive portion 65*b* of the electrode 62*b*. The active-side electrode 62*c* is formed on the piezoelectric element 60*c* so that the left-hand side thereof is smaller by amount equal to the insulating portion 67*d* that is formed next.

Lastly, the insulating portion 67*d* is formed, the conductive portions 65*a* and 65*c* are joined to the active-side terminal 64*a* of the flexible cable 64 with solder 66, and the conductive portions 65*s*, 65*b*, and 65*d* are joined to the active-side terminal 64*b* of the flexible cable 64 with solder 66. The diaphragm 56, which is a base electrode, is thereby directly joined to the flexible cable 64. Wires 72*a* and 72*b* for connecting to the active-side terminal 64*a* and ground-side terminal 64*b*, respectively, are formed on the flexible cable 64. At this time, the range within which connections are made with solder 66 to the active-side terminal 64*a* and ground-side terminal 64*b* of the flexible cable 64 is the range d, as shown in FIG. 7A.

FIG. 7B shows the state in which the members below the flexible cable 64 are laminated on the diaphragm 56. The ground-side electrode is joined to the conductive portions 65*s* and 65*b* with solder 66, and is insulated from the active-side electrode by the insulating portion 67*d* and other components, as shown in FIG. 7B. The active-side electrode is joined to the conductive portions 65*a* and 65*c* with solder 66, and is insulated from the ground-side electrode by the insulating portion 67*a* and other components.

As described above, the layers of the laminated piezoelectric element 58 are sequentially formed, and specific examples of the formation method thereof that are advantageously used include the aerosol deposition method, the sputtering method, the chemical vapor deposition (CVD) method, and the sol-gel method. In other words, since piezoelectric elements 60 and electrodes 62 of the layers of the laminated piezoelectric element 58 can be formed one layer at a time by using the aerosol deposition method, the sputtering method, the CVD method, or another manufacturing method, the dimensions of each layer as described above can be made different and a stepped shape can be formed in a simple manner.

The wiring between the layers can thereby be simultaneously formed, and since the final wiring can be brought out from a single direction (upper surface in the example of FIG. 4, for example), there is no requirement to thereafter perform wiring work on the side surface as is conventionally done, and the density of the laminated piezoelectric elements can be improved.

In the present embodiment, since the actual thickness of each layer of the piezoelectric elements 60 is 10 μm or less, about 5 μm, for example; and the thickness of each layer of the electrodes 62 is about 1 μm to 3 μm, bonding with solder 66 to the terminal 64*a* of the flexible cable 64 can be carried out in a simple manner.

When the length L along one side of the electrode 62*a* of the lowermost layer is set to 500 μm, for example, the width ϵ of the conductive portion 65*a* can be expected to be 20 μm, as shown in FIG. 7A. In other words, the portion of the electrode 62*a* other than the 20 μm width of the conductive portion 65*a* is used as the electrode for driving the laminated piezoelectric element 58.

It should be noted that when the laminated piezoelectric element 58 are laminated in the case that the dimensions of the layers are made different and formed into a stepped shape, the portions that differ in dimension in each layer are not required to be the entire width of the edge surface of each layer, as shown in FIGS. 7A and 7B. The corner of each layer may be notched and formed so that the electrodes (conductive portions) are partially exposed, as shown in FIGS. 8A and 8B, for example.

Figure 8A:
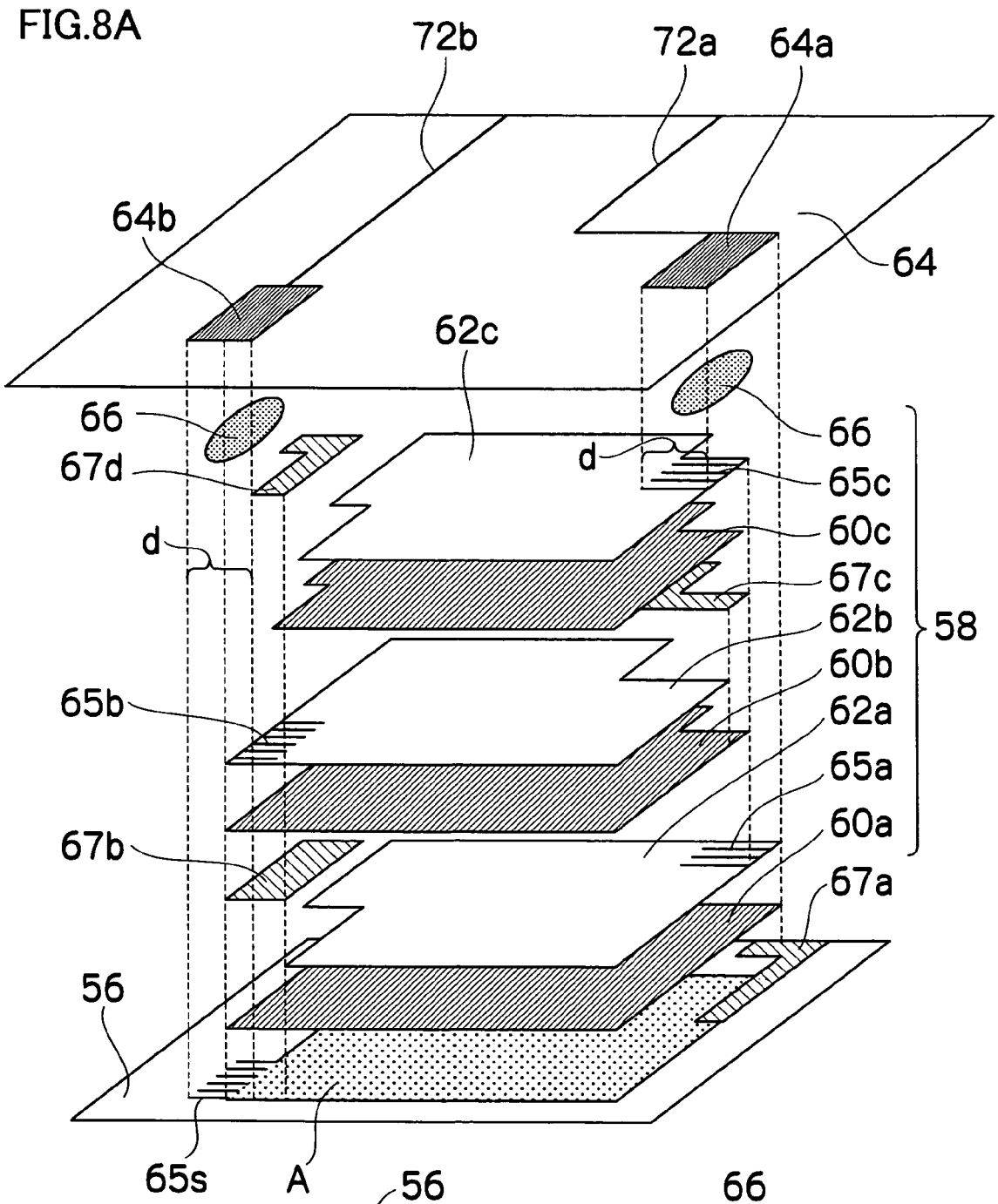
FIGS. 8A and 8B are diagrams showing another method of laminating the laminated piezoelectric elements.
Figure 8B:
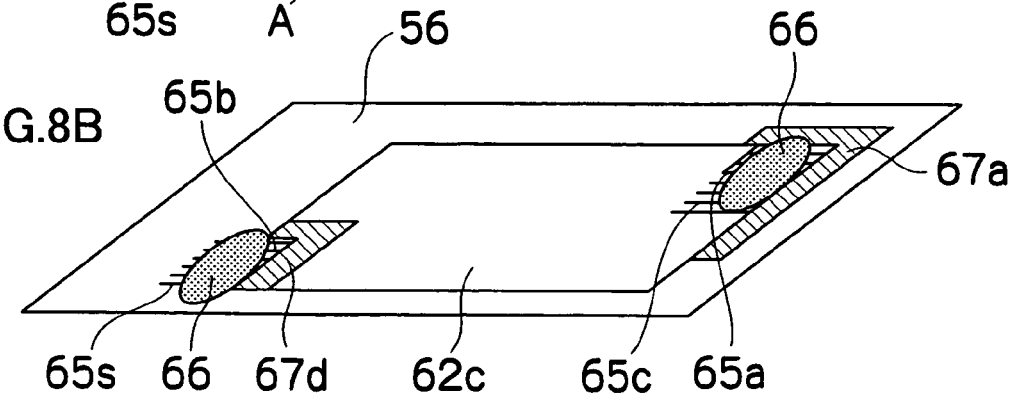

FIG. 8A is a three-dimensional, exploded perspective layer-by-layer view of the laminated piezoelectric element 58 in the same manner as FIG. 7A. In FIG. 8A, the laminated piezoelectric element 58 is laminated in the area A on the diaphragm 56 as a base electrode (ground-side electrode). However, in the example shown in FIGS. 8A and 8B, the electrodes are joined exclusively at the corner portions on the diagonal of each layer.

First, a piezoelectric element 60*a* is laminated in the area A of the diaphragm 56. The piezoelectric element 60*a* is laminated so that the conductive portion 65*s* of the diaphragm 56 disposed in the corner portion of the left front side of the area A is exposed, and so that the insulating portion 67*a* is simultaneously formed of the same material as the piezoelectric element 60*a* in the corner portion of the right rear side.

Next, the left front side is notched by an amount equal to the size of the insulating portion 67*b*, and the electrode 62*a* on the active side is formed on the piezoelectric element 60*a*. The corner portion of the right rear side of the piezoelectric element 60*b* is notched so that the conductive portion 65*a* of the electrode 62*a* is exposed, and the piezoelectric element 60*b* is formed on the electrode 62*a* simultaneously with the insulating portion 67*b*.

The right rear side is notched by an amount equal to the size of the insulating portion 67*c*, and the electrode 62*b* on the ground side is formed on the piezoelectric element 60*b*. The right-hand front side is notched so that the conductive portion 65*b* of the electrode 62*b* is exposed, and the piezoelectric element 60*c* is formed on the electrode 62*b* simultaneously with the insulating portion 67*c*. The left front side is notched thereon by an amount equal to the size of the insulating portion 67*d*, and the right rear side is notched so as to match the piezoelectric element 60*c*.

Lastly, the conductive portions 65*s* and 65*b* on the left front side are joined to the terminal 64*b* of the flexible cable 64 with solder 66, and the conductive portions 65*a* and 65*c* on the right rear side are joined to the terminal 64*a* of the flexible cable 64 with solder 66. The wires 72*a* and 72*b*, which connect to the terminals 64*a* and 64*b*, respectively, are formed on the flexible cable 64.

FIG. 8B shows the state in which the members below the flexible cable 64 are laminated on the diaphragm 56. The ground-side electrode is joined with solder 66 to the conductive portions 65*s* and 65*b* on the left front side, and is insulated from the active-side electrode by the insulating portion 67*d* and other components, as shown in FIG. 8B. The active-side electrode is joined with solder 66 to the conductive portions 65*a* and 65*c* on the right rear side, and is insulated from the ground-side electrode by the insulating portion 67*a* and other components.

Thus, when the electrodes (conductive portions) are formed so as to be partially exposed, or are formed so as to be disposed in different positions for each layer, the dimensional reduction (due to the electrode leads) of the active portion, which is the effective portion of the laminated piezoelectric element 58, can be controlled, the surface area of the active portion of the laminated piezoelectric element 58 can be increased, and a greater ejection force can be obtained without using the entire width of the edge surface of each layer.

In order to reduce the element spacing to the extent possible while taking care that the electrodes 62 of the laminated piezoelectric element 58 formed by lamination have a higher density and do not short, it is effective in the particular case of a two-dimensional arrangement to gather and connect the ground-side electrodes in a single location that does not have a shorting problem.

Described next in FIGS. 9A to 9E is the specific method of aligning the elements in order to achieve higher density.

Figure 9A:
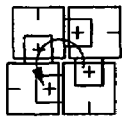
FIGS. 9A to 9E are diagrams showing a method of arranging the piezoelectric elements.

FIG. 9A is a basic format of the alignment method, and four square-shaped pressure chamber units are arranged on which laminated piezoelectric elements are formed with an active-side electrode (+) and a ground-side electrode (−) on the sides thereof.

Figure 9B:
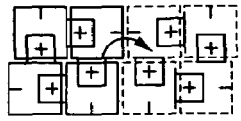
Figure 9C:
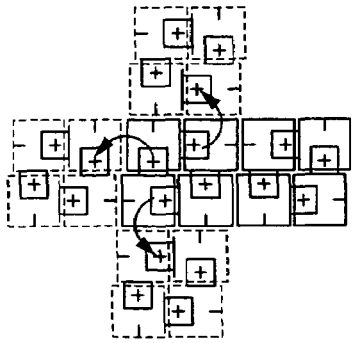
Figure 9D:
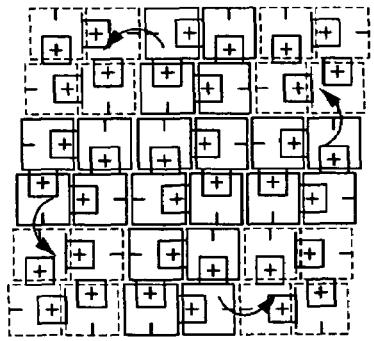

This basic format is reversed on the right-hand side, as shown in FIG. 9B, and the basic format in FIG. 9B is similarly subsequently reversed (laid out) above, to the left, and below, as shown in FIG. 9C. Next, the portions laid out as in FIG. 9C are further laid out above, to the left, below, and to the right, as shown in FIG. 9D.

Figure 9E:
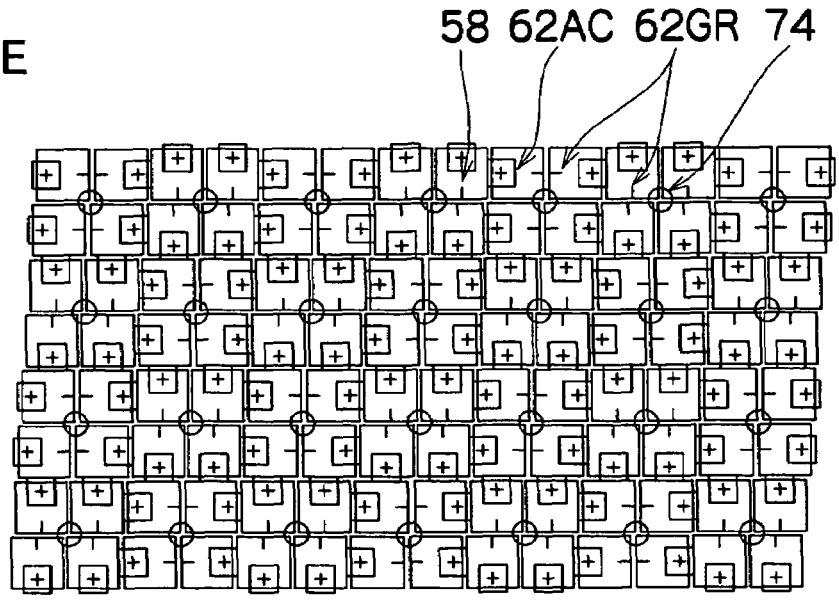

This type of operation is continued to form an arrangement of elements such as that shown in FIG. 9E. Present in FIG. 9E is an active-side electrode $\mathbf{62}_{AC}$ that is represented by the "+" symbol on the sides of the laminated piezoelectric elements 58, and a ground-side electrode $\mathbf{62}_{GR}$ represented by the "−" symbol. The circles indicated by the key symbol 74 are the integral wiring portion of the ground-side electrodes $\mathbf{62}_{GR}$. It should be noted that the active-side electrodes $\mathbf{62}_{AC}$ correspond to the active-side terminals 64*a* of the flexible cable 64 to which the electrodes 62*a* and 62*c* are joined in the example shown in the above-described FIG. 4 or FIGS. 7A and 7B, for example; and the ground-side electrodes $\mathbf{62}_{GR}$ correspond to the ground-side terminals 64*b* of the flexible cable 64 to which the ground electrodes 62*b* (and the diaphragms 56 serving as the ground electrodes) are similarly joined in FIG. 4 or FIGS. 7A and 7B.

The method for arranging the elements in this manner is not particularly limited, and many variations are possible.

Figure 10A:
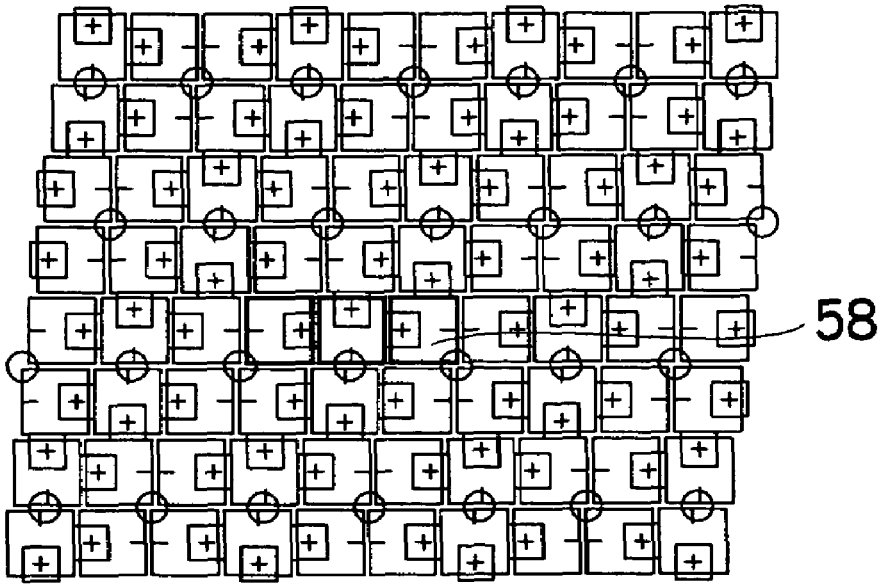
FIGS. 10A and 10B are diagrams showing another example of a method of arranging the piezoelectric elements.
Figure 10B:
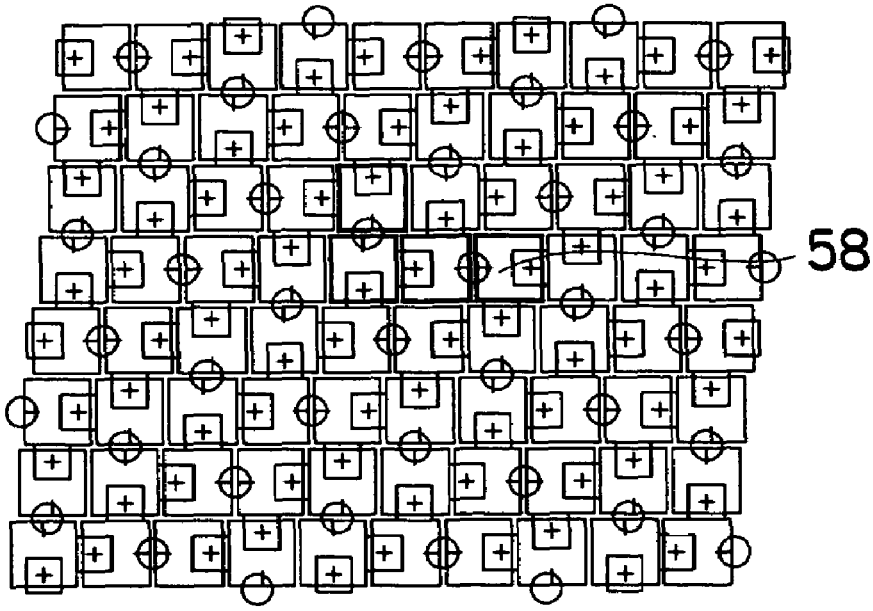

In the example shown in FIG. 10A, the three laminated piezoelectric elements 58 aligned as indicated by the thick lines in the center area is the basic format, and the arrangement is obtained by repeatedly folding the basic format left and right. In the example shown in FIG. 10B, the four laminated piezoelectric elements 58 set in an L-shaped formation as indicated by the thick lines in the center area is the basic format, and the arrangement is obtained by simply offsetting and disposing the basic format one row right diagonally upward and one row left diagonally downward.

Thus, two or more adjacent ground-side electrodes of a plurality of piezoelectric elements two-dimensionally arrayed are disposed facing each other, and the ground-side electrodes are integrally wired. The active-side electrodes are designed to be disposed in positions in which the electrodes between the adjacent elements do not neighbor each other. At this point, the shapes of the piezoelectric elements and the internal electrode preferably include a line symmetry, and are substantially the same shape. Such a plurality of piezoelectric elements may also be arranged in a single dimension.

Such an arrangement allows the ground-side electrodes of the piezoelectric elements to be brought close together, and the active-side electrodes can be disposed in very proximate positions without shorting. Also, the ejection characteristics can be made uniform by making the shapes of the laminated piezoelectric elements (and also the shape of the pressure chambers, and the arrangement of the ink entrances and exits) the same.

Such a structure is not limited to the case in which laminated piezoelectric elements as described above are used, and advantageous application may also be made to cases in which single-layered piezoelectric elements are used. Such a structure can be fabricated by sequentially forming the laminated piezoelectric elements and electrodes using the aerosol deposition method, the sputtering method, the CVD method, or another method.

It is preferable to set the positions of the electrode leads and the inactive portions of the plurality of piezoelectric elements arrayed in a one or two dimensions so that the gap between the adjacent pressure chambers takes in a wide area directly above the portion (portion in which the aperture of the pressure chamber is not present therebelow) in which a pressure chamber does not exist with respect to the shape of the ink pressure chamber in correspondence with the piezoelectric elements.

In order to improve the flow of ink, the pressure chambers of the inkjet recording head are often given a rectangular or rhombic shape, hexagonal shape, elliptical shape, or another shape rather than a square shape so as to eliminate stagnation and to smooth the flow of ink from the ink entrance to the exit. In the particular case of arranging the pressure chambers in a two-dimensional configuration, the portion occupying the pressure chambers is a square shape, a rhombic shape, a hexagonal shape, or another shape that allows maximum density packing.

In view of the above, in the pressure chambers thusly shaped, the ejection force of the piezoelectric elements can be increased by providing the inactive portions and electrodes so as to include the portion in which the gap between the neighboring pressure chambers is kept wide directly above the portion in which pressure chambers are not present.

Figure 11:
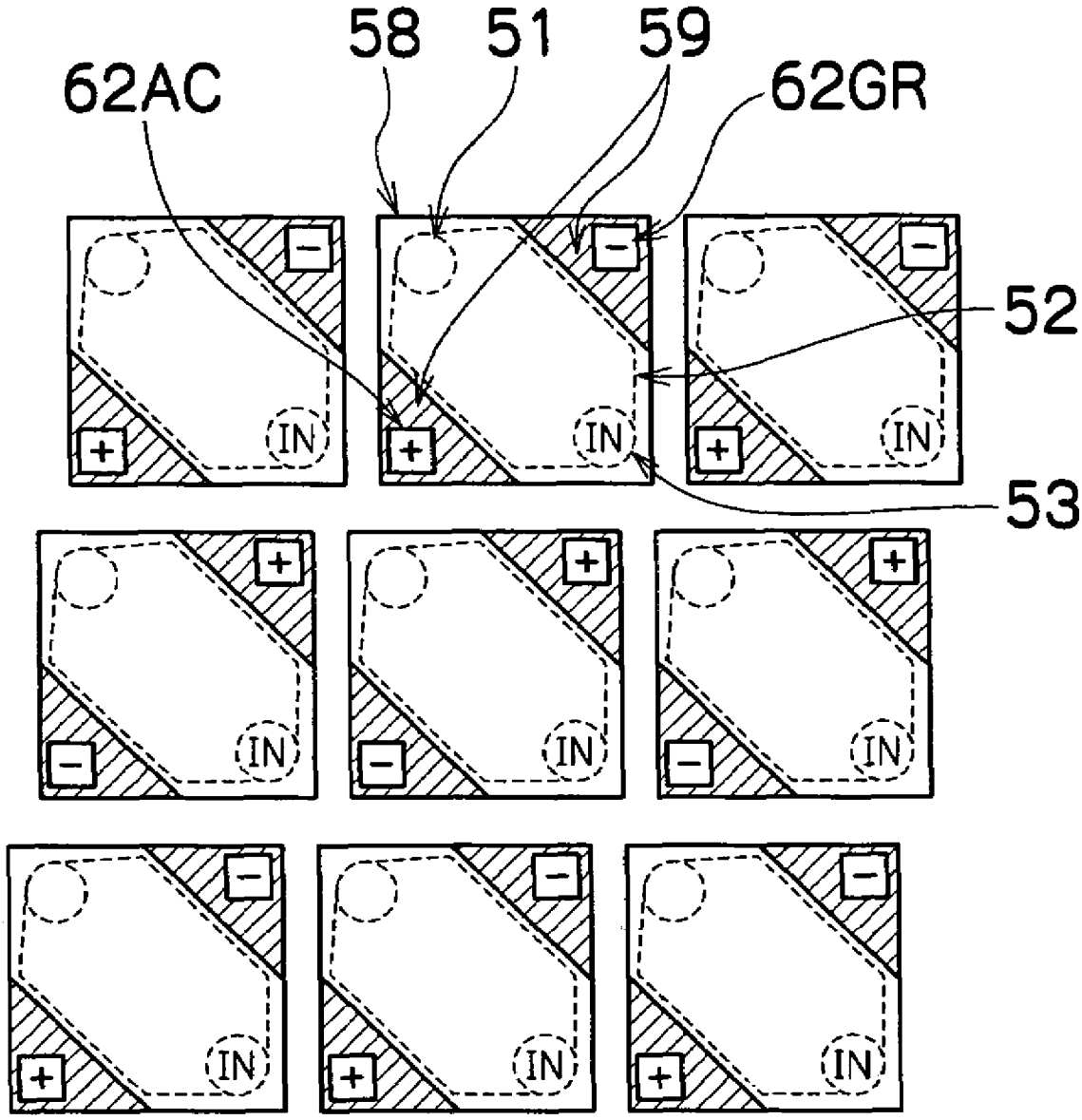
FIG. 11 is a diagram showing an example in which electrodes and other components are disposed in the inactive portion of the piezoelectric elements.

In FIG. 11, for example, each of the square shapes indicated by a solid line are laminated piezoelectric elements 58, the shaded areas are inactive portions 59, the areas therein indicated by the symbol "+" are the active-side electrodes $\mathbf{62}_{AC}$, and the areas indicated by the symbol "−" are the ground-side electrodes $\mathbf{62}_{GR}$. The hexagonal shapes indicated by the dotted lines drawn from the upper left to the lower right around the center of the laminated piezoelectric elements 58 are active portions, and pressure chambers 52 (apertures thereof) are present therebelow.

The areas indicated by the symbol "IN" at the lower right are ink supply ports 53, and the dotted circles in the upper left area are nozzles 51. Therefore, in this case, the ink flows from the lower right to the upper left. In the case of FIG. 11, the electrodes are disposed in the corners, which are inactive portions so as to facilitate bringing the wires close together.

Such a structure can be applied even if laminated piezoelectric elements are used or even if single-layered piezoelectric elements are used, and such a structure can be fabricated by sequentially forming the laminated piezoelectric elements and electrodes using the aerosol deposition method, the sputtering method, the CVD method, or another method.

In accordance with the method shown in the present embodiment, higher density is possible and wiring is facilitated in a configuration composed of a high density head with a large number of nozzles. The configuration is effective in the particular case of arranging the laminated piezoelectric elements in two dimensions, and a thinner wiring structure can be ensured.

As described above, in accordance with the present embodiment, the dimensions, shapes, or positions of the layers are made to be different to form a stepped shape in the layers of the laminated piezoelectric element, and since the wires of each layer are brought out from a single direction (one side), assembly is facilitated, and the configuration is advantageous for higher density because electrodes are not positioned between neighboring elements.

Since the configuration can be formed from one side when the layers are formed by sequential overlaying, the piezoelectric elements, electrodes, and insulating bodies can be successively formed using the aerosol deposition method, for example. Also, when a metal plate mounted on the flexible cable is used to fix the side opposite from the driving surface of the piezoelectric element, the configuration can simultaneously serve as a countermeasure to electrical noise.

Also, one-dimensional or two-dimensional piezoelectric elements can be disposed with high density by closely bringing together and connecting the ground-side electrodes, and disposing the active-side electrodes so they are not adjacent to each other. The generative force of the laminated piezoelectric elements can be further increased when the inactive portions of the piezoelectric elements and electrodes are disposed nearby the portions without a pressure chamber.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording head, comprising:

pressure chambers in which nozzles for discharging ink are formed;

diaphragms which form portions of walls of the pressure chambers;

laminated piezoelectric elements which are disposed on the diaphragms at a side opposite from the pressure chambers and are formed by alternately laminating piezoelectric elements and first and second laminated electrodes for driving the piezoelectric elements in a lamination direction;

first lead electrodes, which have first joining portions connecting with the first laminated electrodes and which impart a first potential to the first laminated electrodes; and second lead electrodes, which have second joining portions connecting with the second laminated electrodes and which impart a second potential to the second laminated electrodes, wherein at least either the first joining portions or the second joining portions are shifted when viewed in the lamination direction so as to connect with the first laminated electrodes or the second laminated electrodes.

2. The inkjet recording head as defined in claim 1, wherein:

dimensions in a crosswise direction of at least either of the first joining portions or the second joining portions are sequentially changed with respect to each layer.

3. The inkjet recording head as defined in claim 2, wherein dimensions in a crosswise direction of both the first joining portions and the second joining portions are sequentially changed with respect to each layer.

4. The inkjet recording head as defined in claim 1, wherein uppermost surfaces of the laminated piezoelectric elements are joined with a flexible cable.

5. The inkjet recording head as defined in claim 4, wherein the uppermost surface of the flexible cable is joined with a weight.

6. The inkjet recording head as defined in claim 1, wherein inactive portions of the piezoelectric elements and the joining portions of the first and second laminated electrodes are provided to portions in which apertures of the pressure chambers are not present.

7. An inkjet recording apparatus, comprising the inkjet recording head as defined in claim 1.

8. The inkjet recording head as defined in claim 1, wherein the opposing portions are the opposing edges of the laminated piezoelectric elements.

9. The inkjet recording head as defined in claim 1, wherein the opposing portions are the opposing corners of the laminated piezoelectric elements.

10. The inkjet recording head as defined in claim 1, wherein a plurality of first lead electrodes are joined together.

11. The inkjet recording head as defined in claim 1, wherein:

the first laminated electrodes comprise a common electrode which is commonly linked to the laminated piezoelectric elements and the second laminated electrodes comprise individual electrodes that individually drive the laminated piezoelectric elements;

the pressure chambers are paired together; and the first lead electrodes associated with each pair of pressure chambers are disposed adjacent to each other and facing each other.

12. The inkjet recording head as defined in claim 11, wherein the first lead electrodes associated with each pair of pressure chambers are joined together.

13. The inkjet recording head as defined in claim 1, wherein the first joining portions and the second joining portions are both shifted when viewed in the lamination direction so as to connect with the first laminated electrodes or the second laminated electrodes.

14. An inkjet recording head comprising:

pressure chambers in which nozzles for discharging ink are formed;

diaphragms which form portions of walls of the pressure chambers;

laminated piezoelectric elements which are disposed separately with respect to each of the pressure chambers on the diaphragms at a side opposite from the pressure chambers and are formed by alternately laminating piezoelectric elements and first and second laminated electrodes for driving the piezoelectric elements in a lamination direction;

first lead electrodes having first joining portions that connect with the first laminated electrodes, the first lead electrodes and which impart a first potential to the first laminated electrodes; and second lead electrodes having second joining portions that connect with the second laminated electrodes, the second lead electrodes and which impart a second potential to the second laminated electrodes, wherein the first laminated electrodes serve as common electrodes connected with each other for the laminated piezoelectric elements and the second laminated electrodes serve as individual electrodes that individually drive the laminated piezoelectric elements, the pressure chambers are two-dimensionally arrayed, the first joining portions and the second joining portions are shifted when seen in terms of the lamination direction so as to connect with the first laminated electrodes and the second laminated electrodes respectively, and the first lead electrodes that are connected with the first laminated electrodes are disposed facing each other in mutually adjacent positions.

15. The inkjet recording head as defined in claim 14 wherein:

the second lead electrodes that are connected with the second laminated electrodes are disposed so as not to face each other in mutually adjacent positions.

16. The inkjet recording head as defined in claim 15, wherein the first lead electrodes and the second lead electrodes are respectively disposed on opposite sides of the laminated piezoelectric elements.

17. The inkjet recording head as defined in claim 15, wherein a plurality of first lead electrodes are joined together.

18. The inkjet recording head as defined in claim 14, wherein the first lead electrodes and the second lead electrodes are respectively disposed on opposite sides of the laminated piezoelectric elements.

19. The inkjet recording head as defined in claim 14, wherein a plurality of first lead electrodes are joined together.

20. An inkjet recording head comprising:

pressure chambers in which nozzles for discharging ink are formed;

diaphragms which form portions of walls of the pressure chambers;

laminated piezoeleetric elements which are disposed separately with respect to each of the pressure chambers on the diaphragms at a side opposite from the pressure chambers and are formed by alternately laminating piezoelectric elements and first and second laminated electrodes for driving the piezoelectric elements in a lamination direction;

first lead electrodes which have first joining portions connecting with the first laminated electrodes and which impart a first potential to the first laminated electrodes; and second lead electrodes which have second joining portions connecting with the second laminated electrodes and which impart a second potential to the second laminated electrodes, wherein the first laminated electrodes serve as common electrodes connected with each other for the laminated piezoelectric elements and the second laminated electrodes serve as individual electrodes that individually drive the laminated piezoelectric elements, the pressure chambers are two-dimensionally arrayed, the first joining portions and the second joining portions are shifted when seen in terms of the lamination direction so as to connect with the first laminated electrodes and the second laminated electrodes respectively, and the second lead electrodes that are connected with the second laminated electrodes are disposed so as not to face each other in mutually adjacent positions.

21. The inkjet recording head as defined in claim 20, wherein the first lead electrodes and the second lead electrodes are respectively disposed on opposite sides of the laminated piezoelectric elements.

* * * * *